US008790233B2

(12) United States Patent
Ridderstrale et al.

(10) Patent No.: US 8,790,233 B2
(45) Date of Patent: Jul. 29, 2014

(54) METHOD AND DEVICE FOR CLEANING OF A FLUID IN A CENTRIFUGAL SEPARATOR

(75) Inventors: Rolf Ridderstrale, Stockholm (SE); Claes Wase, Tullinge (SE)

(73) Assignee: Alfa Laval Corporate AB, Lund (SE)

( * ) Notice: Subject to any disclaimer, the term of this patent is extended or adjusted under 35 U.S.C. 154(b) by 823 days.

(21) Appl. No.: 12/598,778

(22) PCT Filed: May 9, 2008

(86) PCT No.: PCT/SE2008/000320

§ 371 (c)(1), (2), (4) Date: Nov. 4, 2009

(87) PCT Pub. No.: WO2008/140378

PCT Pub. Date: Nov. 20, 2008

(65) Prior Publication Data

US 2010/0144508 A1 Jun. 10, 2010

(30) Foreign Application Priority Data

May 10, 2007 (SE) ..... 0701136

(51) Int. Cl.
*B04B 1/08* (2006.01)
*B04B 1/20* (2006.01)

(52) U.S. Cl.
USPC ..... 494/53; 494/70; 494/901

(58) Field of Classification Search
CPC .... B04B 1/20; B04B 1/08; B04B 2001/2041; B04B 2001/2066
USPC ..... 494/23–30, 37, 53–54, 68–73, 901; 210/380.1, 380.3
See application file for complete search history.

(56) References Cited

U.S. PATENT DOCUMENTS 2,622,794 A * 12/1952 Smith ..... 494/53
2,625,320 A * 1/1953 Lyons ..... 494/37
2,743,864 A * 5/1956 Lyons ..... 494/54

(Continued)

FOREIGN PATENT DOCUMENTS

CH 301080 A * 8/1954
DE 965027 C * 5/1957

(Continued)

OTHER PUBLICATIONS

PCT International Search Report; International Application No. PCT/SE2008/000320, International Filing Date May 9, 2008.

*Primary Examiner* — Charles Cooley
(74) *Attorney, Agent, or Firm* — MKG, LLC

(57) ABSTRACT

A method for purifying a fluid from contaminating particles in a centrifugal separator with use of a separation aid which is of higher density than the fluid and which binds said particles, the centrifugal separator having a rotor body that rotates about an axis of rotation. The fluid to be purified is led via an inlet into a separation chamber delimited by the rotor body. Separated particles are discharged via a first outlet and clarified fluid cleared is discharged via a second outlet. The fluid being mixed with an amount of separation aid, supplied to the separation chamber. The pollutant particles are bound to the separation aid, which is forced out by the rotation of the rotor body to the periphery thereof. A small flow of separation aid and particles bound thereto are discharged from the separation chamber via the first outlet, and a flow of purified fluid is discharged from the separation chamber via the second outlet.

17 Claims, 3 Drawing Sheets

(56) References Cited

U.S. PATENT DOCUMENTS

| | | | | | |
|---|---|---|---|---|---|
| 2,907,517 | A | * | 10/1959 | Ziherl | 494/26 |
| 2,919,848 | A | * | 1/1960 | Howe | 494/42 |
| 3,424,375 | A | * | 1/1969 | Maurer | 494/4 |
| 3,777,972 | A | | 12/1973 | Kjellgren | |
| 4,009,823 | A | * | 3/1977 | Nozdrovsky | 494/27 |
| 4,042,172 | A | * | 8/1977 | Nozdrovsky | 494/53 |
| 4,209,128 | A | * | 6/1980 | Lyons | 494/37 |
| 4,335,846 | A | * | 6/1982 | Shapiro | 494/54 |
| 4,784,634 | A | | 11/1988 | Schiele | |
| 5,310,399 | A | * | 5/1994 | Suzuki | 494/54 |
| 5,314,399 | A | * | 5/1994 | Suzuki | 494/54 |
| 5,364,335 | A | * | 11/1994 | Franzen et al. | 494/15 |
| 5,494,579 | A | * | 2/1996 | Robatel et al. | 210/380.1 |
| 6,030,332 | A | * | 2/2000 | Hensley | 494/53 |
| 6,056,685 | A | * | 5/2000 | Nelson | 494/53 |
| 6,537,191 | B1 | * | 3/2003 | Stroucken et al. | 494/53 |
| 6,712,751 | B2 | * | 3/2004 | Stroucken et al. | 494/53 |
| 6,716,153 | B2 | * | 4/2004 | Stroucken et al. | 494/53 |
| 7,083,565 | B2 | * | 8/2006 | Hermeler et al. | 494/53 |
| 7,410,457 | B2 | * | 8/2008 | Heinrich | 494/70 |
| 2003/0032540 | A1 | * | 2/2003 | Stroucken et al. | 494/53 |
| 2003/0032541 | A1 | * | 2/2003 | Stroucken et al. | 494/53 |
| 2006/0142137 | A1 | * | 6/2006 | Hermeler et al. | 494/53 |
| 2007/0241030 | A1 | * | 10/2007 | Strom | 208/181 |
| 2010/0144508 | A1 | * | 6/2010 | Ridderstrale et al. | 494/50 |
| 2012/0040443 | A1 | * | 2/2012 | Wase et al. | 435/271 |
| 2012/0267303 | A1 | * | 10/2012 | Oldeback et al. | 494/37 |
| 2013/0157833 | A1 | * | 6/2013 | Konigsson et al. | 494/5 |
| 2013/0210601 | A1 | * | 8/2013 | Zheng et al. | 494/53 |

FOREIGN PATENT DOCUMENTS

| | | | | | |
|---|---|---|---|---|---|
| GB | 708590 | A | * | 5/1954 | |
| RU | 1438067 | A2 | * | 1/1995 | B04B 1/20 |
| RU | 1656741 | A2 | * | 1/1995 | B04B 1/20 |
| WO | 2004053035 | A1 | | 6/2004 | |
| WO | WO 2005111181 | A1 | * | 11/2005 | B04B 1/20 |
| WO | 2011053224 | A | * | 5/2011 | B04B 1/20 |

* cited by examiner

METHOD AND DEVICE FOR CLEANING OF A FLUID IN A CENTRIFUGAL SEPARATOR

FIELD OF THE INVENTION

The present invention relates to an apparatus and method for purifying a fluid, in which the fluid is purified of contaminating particles in a centrifugal separator by means of a separation aid which is of higher density than the fluid and which binds these particles.

BACKGROUND TO THE INVENTION

WO 2004/053035 discloses a device in the form of a centrifugal separator for purifying an oil from particles. For the purification of the oil, a separation aid which binds the particles is added and thereby increases the degree of separation compared with using only the rotation of the rotor.

A problem with the purifying of oil according to the prior art is that some of the particles separated from the oil deposit themselves, together with separation aid, on the inside of the rotor in the form of a highly viscous layer of separated particles and separation aid. This layer of separated particles constitutes a relatively solid sludge phase which grows radially inwards towards the axis of rotation, impairing the degree of separation and ultimately rendering continued separation impossible because of obstruction.

SUMMARY OF THE INVENTION

The present invention resides in one aspect in separation aid and particles bound thereto that are conveyed along the inside of a rotor body forming part of a centrifugal separator by a conveying thread towards and out through a first outlet.

One object of the present invention is to provide a simple device for improving the degree of separation of the fluid.

According to an embodiment of the present invention, the method comprises adding a small amount of liquid separation aid to the fluid, which separation aid is of higher density than the fluid, before it enters the centrifugal separator, which is thereafter caused to rotate. The separation aid with the collected particles therein leaves the rotor body via the first outlet.

According to a further embodiment of the invention, the method comprises a discharge of higher density fluid via a third outlet arranged in the centrifugal separator at a radial distance from the axis of rotation between the first and a second outlet. Higher density fluid discharged via the third outlet may contain particles which have been separated from the fluid but have not settled out and formed a sludge phase. The higher density fluid may also contain separation aid and/or water.

According to a further embodiment of the invention, the method comprises fluid consisting of an oil, such as, but not limited to some kind of lubricating oil. The lubricating oil which is to be purified may have been used as lubricant, for example, in a diesel engine and been contaminated by solid particles dispersed in the oil. The fluid which is to be purified may however also consist of, for example, hydraulic oil, cylinder oil, cutting oil, rolling oil, hardening oil, mineral oil or any other suitable oil. The invention is not limited to the abovementioned examples of fluids, as the latter may further consist such things as but not limited to of bilge water, biodiesel or dispersed kaolin. The fluid may for example further consist of foodstuff or a pharmaceutical or chemical.

According to a further embodiment of the invention, the separation aid involved in the method comprises at least one of a liquid polymer, a water-soluble polymer, a hydrophilic polymer, a hydrophobic polymer, a lipophilic polymer, a fatty acid or combinations thereof. The polymer may further comprise a polyhydroxy-based alkoxylate with a higher density than the higher density fluid at the relevant separation temperature. An example of a polymer of the kind indicated above is referred to in WO 2005/111181. That polymer is particularly suitable for use with the method according to the invention because it can separate out pentane-insoluble contaminants from the oil which is to be purified. This has previously been difficult in that only 2-4% of pentane-insoluble contaminants could be separated out by conventional methods. By the method according to the invention 99% of the pentane-insoluble contaminants can be separated out, resulting in a considerably cleaner product.

BRIEF DESCRIPTION OF THE DRAWINGS

The invention will explain more closely by describing various exemplary, but not limiting embodiments with reference to the following drawings.

DETAILED DESCRIPTION OF VARIOUS EMBODIMENTS OF THE INVENTION

Figure 1:
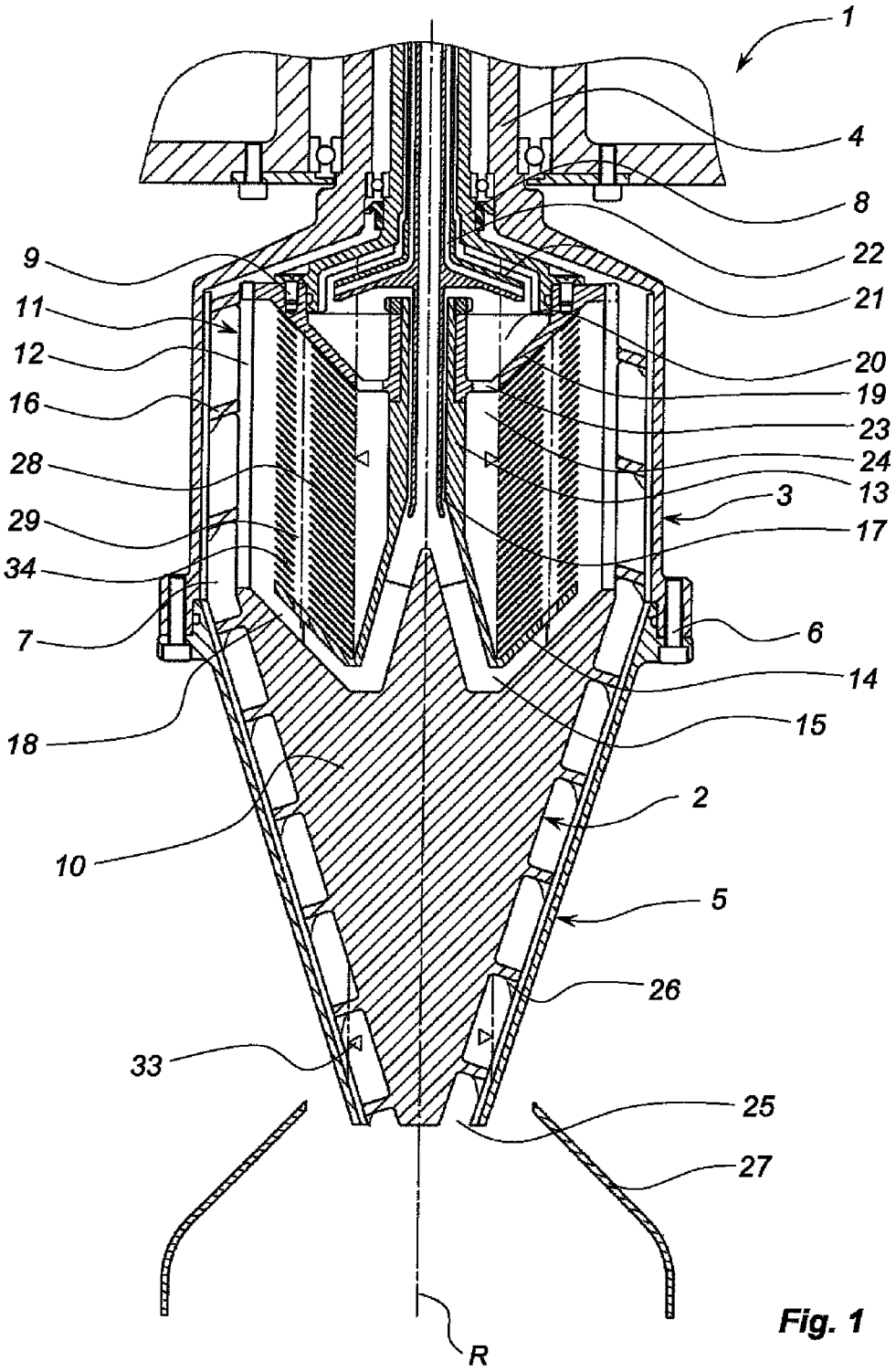
FIG. 1 discloses schematically a view of a centrifugal separator according to an embodiment of the invention.

FIG. 1 discloses an example of a centrifugal separator comprising a rotor body 1 which is rotatable at a certain speed about a vertical axis of rotation R, and a screw conveyor 2 which is arranged in the rotor body 1 and rotatable about the same axis of rotation R but at a speed which differs from the rotation speed of the rotor body 1.

The centrifugal separator is intended to be suspended vertically in a manner indicated by WO 99/65610. The device necessary for suspending and driving the centrifugal separator is therefore not described here.

The rotor body 1 has an essentially cylindrical upper rotor portion 3 comprising or connected to a hollow rotor shaft 4, and an essentially conical lower rotor portion 5. The rotor portions 3 and 5 are connected to one another by screws 6 and delimit a separation chamber 7. Alternative connecting arrangements may also be used.

A shaft 8, shown in the illustrated embodiment as being hollow, extends into the rotor body 1 via the inside of the rotor shaft. The shaft 8 bears the screw conveyor 2 and they are connected to one another by screws 9. The shaft 8 is drivingly connected to the screw conveyor 2 and is hereinafter called the conveyor shaft.

As illustrated in FIG. 1, the screw conveyor 2 comprises a central core 10, which extends axially through the lower rotor portion, a sleeve-formed part 11 comprising a number of apertures 12 which are distributed around the axis of rotation R and extend axially from the upper portion of the screw conveyor 2 to the conical portion of the screw conveyor 2, a number of wings 15 which are distributed around the axis of rotation R and connect the core 10 to a central sleeve 13 situated at a radial distance from the axis of rotation R within the sleeve-formed part 11 of the screw conveyor 2, which central sleeve 13 changes to a conical portion and a lower support plate 14, and at least one conveying thread 16 which extends in a screw-like manner along the inside of the rotor body 1 from the latter's upper end to its lower end and is itself connected to the sleeve-formed part 11 and the core 10. The at least one conveying thread 16 may of course be supplemented by a suitable number of conveying threads, e.g. two, three or four, which all extend in a screw-like manner along the inside of the rotor body 1.

An inlet pipe 17 for supply of a liquid mixture which is to be treated in the rotor body 1 extends through the conveyor shaft 8 and leads on into the central sleeve 13. The inlet pipe 17 discharges axially before said wings 15 into a space centrally in the screw conveyor 2. Axially closer to the core 10, the core and the lower support plate 14 form a passage 18 which constitutes a continuation of the inlet channel which extends through the inlet pipe 17. The passage 18 is in communication with the inside of the rotor body 1 via channels between the wings 15.

A space in the form of an outlet chamber 20 is formed between the conveyor shaft 8 and an upper conical support plate 19. A paring disc 21 for discharging purified liquid is disposed within the outlet chamber 20. The paring disc 21 is firmly connected to the inlet pipe 17. An outlet channel 22 for the purified liquid extends in an outlet pipe which surrounds the inlet pipe 17 and defines the second outlet.

A centrally and axially directed outlet 25 for separated particles (sludge) 26 is arranged at the lower end of the rotor body 1 and defines the first outlet. In connection with this outlet 25 for sludge 26, the rotor body 1 is surrounded by a device 27 for intercepting sludge 26 which leaves the outlet 25. The sludge 26 is disclosed in the drawings in the form of accumulations at the radially outer portion of the conveying thread 16, on the latter's side which faces towards the first outlet 25.

The rotor body 1 further comprises a stack of truncated conical separation discs 28 which are examples of surface-enlarging inserts. These are fitted substantially coaxially with the rotor body 1 substantially centrally in its cylindrical portion 3. The conical separation discs 28, which have their base ends facing away from the outlet 25 for separated particles, are held together axially between the upper conical support plate 19 and the lower conical support plate 14 by the central sleeve 13 which extends through the stack of truncated conical separating discs 28. The separation discs 28 comprise holes which form channels 29 for axial flow of liquid when the separation discs 28 are fitted in the centrifugal separator. The upper conical support plate 19 comprises a number of apertures 23 which connect the space 24 situated radially within the stack of separation discs to the outlet chamber 20.

Alternatively, the conical separation discs 28 may be so oriented that they have their base ends facing towards the outlet 25 for separated particles.

Figure 2:
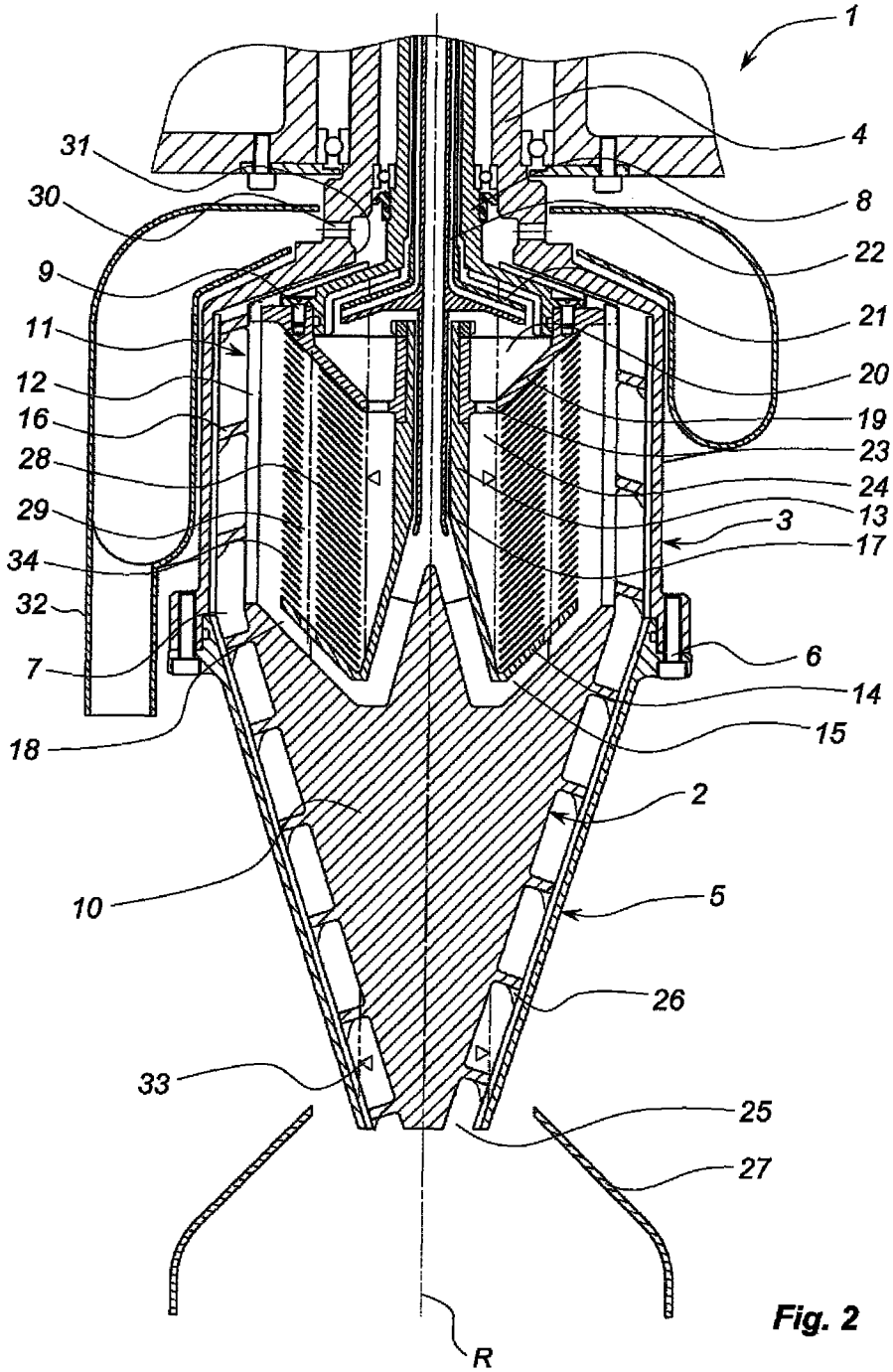
FIG. 2 discloses schematically a view of a centrifugal separator according to a further embodiment of the invention.

The parts in FIG. 1 which are the same have corresponding reference numbers in FIG. 2.

FIG. 2 discloses a further embodiment of the centrifugal separator in which the rotor body 1 at its upper end comprises at least one outlet 30 for fluid with a higher density than the fluid which has been purified and is led out through said paring disc 21, which at least one outlet 30 defines the third outlet. In the region of the at least one outlet 30, somewhat below this outlet, a flange is arranged which forms an overflow outlet 31 for fluid in the rotor body 1 which flows towards and out through the at least one outlet 30. The flange's overflow outlet 31 is adapted to maintain an interface level between a higher density fluid and a lower density fluid in the rotor body 1 at a radial level (level not disclosed in the figure). This interface level can be regulated radially in the separation chamber 7 by selecting the extent of the overflow outlet 31 in the radial direction. According to the embodiment disclosed in FIG. 2, the centrifugal separator comprises a device 32 which surrounds the rotor body 1 and is adapted to intercept liquid which leaves the rotor body 1 through the at least one outlet 30. FIG. 2 discloses the at least one outlet 30 as an open outlet. Alternatively, this outlet may also, in the same way as at the second outlet 22, be provided with a space for collecting of fluid and a paring disc for discharge of fluid from this space. Such an alternative outlet—to the open outlet disclosed in FIG. 2—is disclosed in FIG. 3. The parts in FIG. 2 which are the same have corresponding reference signs in FIG. 3.

Figure 3:
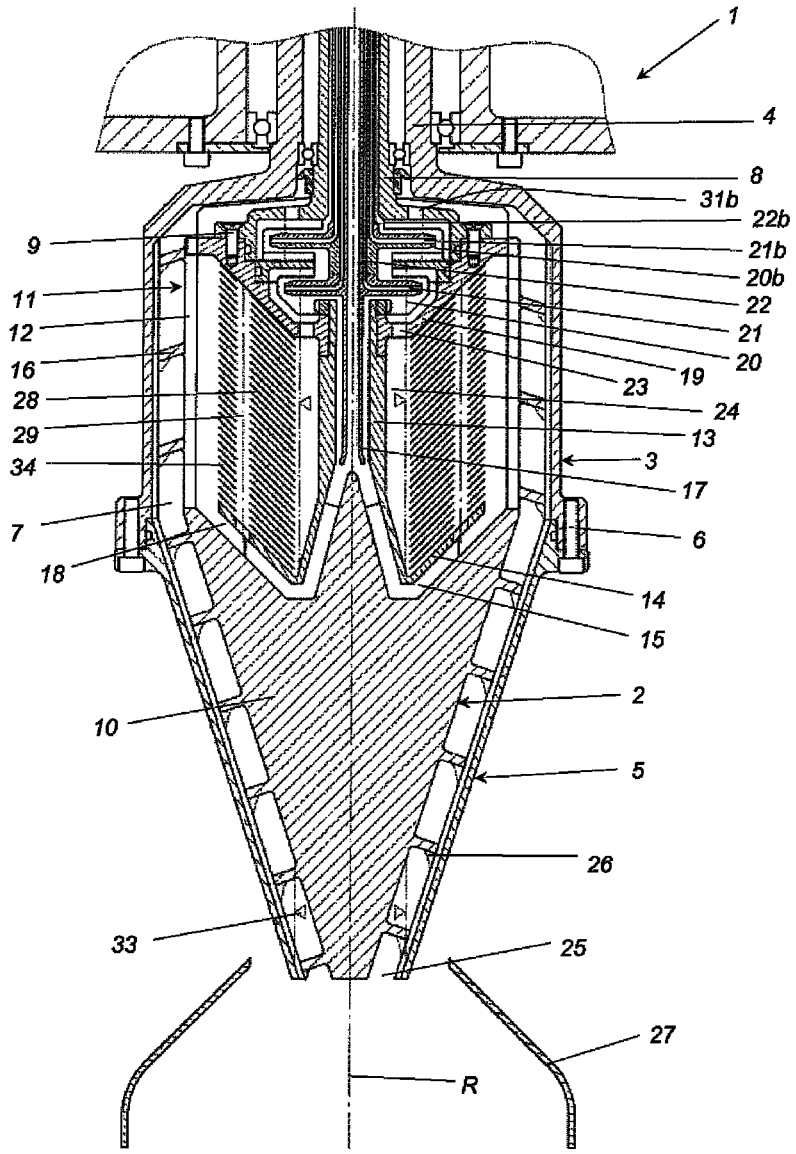
FIG. 3 discloses schematically a view of a centrifugal separator according to a further embodiment of the invention.

FIG. 3 discloses accordingly a further embodiment of the centrifugal separator provided with said alternative outlet for relatively higher density fluid. To this end, the outlet is configured in substantially the same way as the second outlet 22 for relatively lower density fluid. Thus a further space in the form of an outlet chamber **20*b* for higher density fluid is formed between the conveyor shaft 8 and the outlet chamber 20 for lower density fluid (purified liquid). A paring disc 21*b* for discharge of higher density fluid is arranged within this outlet chamber 20*b*, wherein the paring disc 21*b* communicates with an outlet channel 22*b* for that fluid. The outlet channel 22*b* for higher density fluid extends in an outlet pipe which surrounds the outlet pipe and the outlet channel 22 for lower density fluid (purified liquid). The conveyor shaft 8 comprises a number of holes 31*b* which connect an annular space situated radially outside the stack of separation discs with the outlet chamber 20*b* for higher density fluid. The holes 31*b* are adapted to form an overflow outlet corresponding to that disclosed in FIG. 2 for fluid in the rotor body 1 which flows towards and out through the outlet for higher density fluid, in such a way that an interface level between higher density fluid and lower density fluid is maintained at a radial level (level not disclosed in FIG. 3) in the rotor body 1. The outlet described with the paring disc makes it possible for the centrifugal separator's outlet 22*b* for higher density fluid to be adapted, instead of communicating with said device 32 (in FIG. 2) which surrounds the rotor body in order to intercept liquid which leaves the open outlet, to communicate with a collection device (such as a collection tank) which may be arranged at a distance from, and at a higher level than, the centrifugal separator (not disclosed in FIG. 3**). Fluid is thus pumped out from the centrifugal separator to the collection device through the paring disc.

The invention is of course not limited to the orientation of the axis of rotation R disclosed in the figures. The term "centrifugal separator" also comprises centrifugal separators with a substantially horizontally oriented axis of rotation. According to the embodiments disclosed in FIGS. 1-3, the centrifugal separator is suspended and journalled at its one end. Centrifugal separators of this kind may also be suspended at the outlet 25 for separated particles.

The centrifugal separators described above functions in the following manner during rotation of the rotor body 1.

The separation aid is added to the contaminated fluid before it enters the centrifugal separator. The addition of separation aid takes place via a static mixer or by means of a stirrer which provides optimum distribution of the separation aid in the fluid and good contact between the separation aid and the contaminating particles. The amount of separation aid added varies depending on the amount of fluid which is to be cleaned and its degree of contamination.

The mixture of fluid to be purified and separation aid is fed into the centrifugal separator, when the latter has been caused to rotate, via the inlet 17 to the separation chamber 7, putting the mixture into rotation and hence subjecting it to centrifugal force. The result is the gradual formation of a free liquid surface at level 33, the position of which is determined by the apertures 23.

Particles separated from the fluid and sludge formed at the periphery of the rotor body is fed by the screw conveyor 2 axially towards the conical portion 5 of the rotor body 1 and proceed out through the first outlet 25.

The fluid relieved of a plurality of particles by the separation aid is further fed through gaps 34 formed between the conical separating discs 28. The fluid can thereby be further purified by not yet separated particles and separation aid depositing themselves on the separating discs 28 and being projected radially outwards, while the purified fluid passes on radially inwards and out via the second outlet 22. According to the embodiments disclosed in FIG. 2 and FIG. 3 respectively, particles and separation aid which have not formed a sludge phase but are still in a lighter phase are extracted via the third outlet 30 and 22*b* respectively.

The invention is not limited to the embodiments disclosed but may be varied and modified within the scope of the claims set out below.

What is claimed is:

1. A method for purifying oil from contaminating particles in a centrifugal separator by means of a separation aid which is of higher density than the oil and which binds said particles, comprising a centrifugal separator having a rotor body caused to rotate about an axis of rotation, said rotor body comprising a cylindrical upper portion and a conical lower portion, and a stack of truncated conical separation discs arranged centrally in the cylindrical upper portion, the separation discs having base ends facing away from a first outlet for separated particles, said upper portion and said lower portion delimiting a separation chamber, the oil which is to be cleaned is discharged from an inlet, and is after discharge led via channels to the upper portion into the separation chamber delimited by the rotor body and upwards through openings in the separation discs which form an axial channel for axial flow of the oil to be cleaned, the separated particles are discharged via the first outlet and the oil cleared of said particles is discharged via a second outlet, said oil being mixed with an amount of separation aid, being supplied to the separation chamber and being purified therein by the pollutant particles being bound to said separation aid, which separation aid is forced out by the rotation of the rotor body to the periphery of the rotor body, a small flow of separation aid and particles bound thereto being discharged from the separation chamber via the first outlet, and a flow of purified oil being discharged from the separation chamber via the second outlet, and conveying said separation aid and particles bound thereto along the inside of the rotor body by at least one conveying thread towards and out through the first outlet; and wherein the first outlet is centrally and axially directed and arranged at a lower end of the rotor body, and the rotor body is suspended and journalled at its upper end.

2. A method according to claim 1, wherein a sludge phase of the separation aid and the bound particles is conveyed by the at least one conveying thread towards and out through the first outlet.

3. A method according to claim 2, wherein portions of fluid with a higher density are discharged via a third outlet disposed in the centrifugal separator at a radial distance from the axis of rotation (R) between the first outlet and the second outlet, which higher density fluid comprises particles separated from the oil but not settled-out and formed sludge phase.

4. A method according to claim 1, wherein the oil comprises a lubricating oil.

5. A method according to claim 1, where the oil has been used as lubricant in a diesel engine and is contaminated by solid particles dispersed in the oil.

6. A method according to claim 1, wherein the separation aid comprises a water-soluble polymer.

7. A method according to claim 6 wherein the polymer comprises a polyhydroxy-based alkoxylate.

8. A method according to claim 1, wherein the separation aid comprises a hydrophilic polymer.

9. A method according to claim 8 wherein the polymer comprises a polyhydroxy-based alkoxylate.

10. A method according to claim 1, wherein the separation aid comprises a fatty acid.

11. A method according to claim 1, wherein the separation aid comprises a combination of, at least two of, a water soluble polymer, a hydrophyllic polymer, and a fatty acid.

12. A method according to claim 1 wherein the oil is fed substantially centrally into the rotor body.

13. A method according to claim 1, wherein pentane-insoluble contaminants are separated from the oil by means of said separation aid.

14. A method for purifying oil from contaminants, contaminant particles or other particles, comprising subjecting the oil which is to be purified to centrifugal force in a device which comprises surface-enlarging inserts, wherein one or more separation aid is added to the oil before being subjected to the centrifugal force and wherein fluids are separated into their various phases, and a sludge phase is conveyed along the inside of a rotor body by at least one conveying thread towards and out through a first outlet, said rotor body comprising a cylindrical upper portion and a conical lower portion, and a stack of truncated conical separation discs arranged centrally in the cylindrical upper portion, the separation discs having base ends facing away from a first outlet for separated particles, said upper portion and said lower portion delimiting a separation chamber, the oil which is to be cleaned is discharged from an inlet, and is after discharge led via channels to the upper portion into the separation chamber delimited by the rotor body and upwards through openings in the separation discs which form an axial channel for axial flow of the oil to be cleaned, the separated particles are discharged via the first outlet and the oil cleared of said particles is discharged via a second outlet; and wherein the first outlet is centrally and axially directed and arranged at a lower end of the rotor body, and the rotor body is suspended and journalled at its upper end.

15. A device configured to purify oil from contaminating particles, comprising: a rotor body rotating about an axis of rotation, which rotor body has a separation chamber with an inlet for oil which is to be purified and a separation aid configured to be added to the oil before being subjected to the rotating, a first outlet for separated particles, and a second outlet for oil which has been cleared of said particles, the rotor body having at least one conveying thread along the inside of the rotor body for conveying the separation aid and particles bound to the separation aid towards and out through the first outlet, said rotor body comprising a cylindrical upper portion and a conical lower portion, and a stack of truncated conical separation discs arranged centrally in the cylindrical upper portion, the separation discs having base ends facing away from a first outlet for separated particles, said upper portion and said lower portion delimiting the separation chamber, the oil which is to be cleaned is discharged from the inlet, and is after discharge led via channels to the upper portion into the separation chamber delimited by the rotor body and upwards through openings in the separation discs which form an axial channel for axial flow of the oil to be cleaned, the separated particles are discharged via the first outlet and the oil cleared of said particles is discharged via the second outlet; and wherein the first outlet is centrally and axially directed and arranged at a lower end of the rotor body, and the rotor body is suspended and journalled at its upper end.

16. A device according to claim 15, wherein the rotor body comprises a screw conveyor to which said at least one conveying thread is connected and which is rotatable about the axis of rotation (R) at a speed which differs from the rotation speed of the rotor body.

17. A device according to claim 15, wherein the rotor body comprises a third outlet for fluid with a higher density than fluid which is discharged via the second outlet during rotation of the rotor body.

* * * * *